United States Patent [19]

Ellis

[11] Patent Number: 4,898,494

[45] **Date of Patent: * Feb. 6, 1990**

[54] SUBSURFACE WATER DRAINAGE SYSTEM

[76] Inventor: Donn Ellis, 3624 Chevron Dr., Highland, Mich. 48031

[ * ] Notice: The portion of the term of this patent subsequent to Dec. 27, 2005 has been disclaimed.

[21] Appl. No.: 235,196

[22] Filed: Aug. 23, 1988

Related U.S. Application Data

[63] Continuation-in-part of Ser. No. 49,856, May 13, 1987, Pat. No. 4,793,728.

[51] Int. Cl.[4] ..... E01C 11/22

[52] U.S. Cl. ..... 404/002; 404/3; 405/50; 285/176; 285/178; 285/260

[58] Field of Search ..... 404/2–4, 404/14; 52/169.5, 169.14; 405/43, 45, 50; 210/170, 747; 285/176, 178, 260, 903

[56] References Cited

U.S. PATENT DOCUMENTS

| | | | |
|---|---|---|---|
| 3,695,643 | 10/1972 | Schmunk | 285/903 |
| 3,727,953 | 4/1973 | Martin | 285/903 |
| 4,490,072 | 12/1984 | Glasser | 405/45 |
| 4,597,693 | 7/1986 | McQuary | 404/2 |
| 4,639,165 | 1/1986 | Fleeknoe-Brown | 405/43 |
| 4,793,728 | 12/1988 | Ellis | 404/2 |

*Primary Examiner*—Jerome W. Massie, IV
*Assistant Examiner*—Gay Spahn
*Attorney, Agent, or Firm*—Gifford, Groh, Sprinkle, Patmore and Anderson

[57] ABSTRACT

A drainage system for location adjacent a pavement subbase includes a tube of a geotextile fabric supported by a self-sustaining water-porous plastic support. An end of the fabric tube and its encased support are compressively received in the flared open end of an outlet connected to a conventional drainpipe. The outlet includes a plurality of projections which trap the fabric tube between the support and the outlet, so as to securely retain it therein. The outlet also preferably includes a plurality of circular beads over which a corrugated drain tube can be frictionally slipped. Alternatively, the outlet can be configured as a flat union or T-shaped junction joining one or more upstream fabric tube-and-support filters with a downstream outlet constructed from an identical fabric tube and support. The downstream outlet can also be in the form of a union for connecting two or more upstream fabric tube-and-support filters in addition to having means for connecting to a drainpipe or the like.

14 Claims, 5 Drawing Sheets

SUBSURFACE WATER DRAINAGE SYSTEM

RELATION TO OTHER APPLICATIONS

This application is a continuation-in-part of my copending application Ser. No. 049,856, filed May 13, 1987, now issued as U.S. Pat. No. 4,793,728.

BACKGROUND OF THE INVENTION

I. Field of the Invention

The present invention is directed to a system for water drainage, and more particularly to a subsurface system for draining water from beneath covered ground, such as the subbase of a roadway.

II. Description of the Prior Art

A major cause of damage to road surfaces is the entrapment or retention of water beneath the road surface, in the road base or subbase. Such retained water can cause potholes, buckles and gaps in the pavement, as well as cracking or crumbling of the pavement, and can lead to premature collapse or failure of the roadbed. Rapid subsurface drainage of the roadbed is thus critical to extending the useful life of the highway.

The (HYDRAWAY) (trademark of Monsanto Chemical Company, St. Louis, Mo.) drain is a known drainage system useful for this purpose. It comprises a tubular, internally supported geotextile fabric filter disposed in the ground beneath or preferably adjacent a covered ground surface, for example, in the subbase of a highway or pavement. The filter support is constructed of a somewhat rigid but resiliently deformable polyethylene core, about which the filter is circumferentially disposed, and to which the filter is bonded. This known drain is asserted to have flow characteristics two to three times better than those of conventional sand-backfilled drainage systems. The Hydraway drain is also asserted to be more resistant to clogging from dirt, gravel and sand transported by the water drained through the system.

The filter and contained support of the Hydraway drain are generally rectangular, conveniently 12, 18 or 36 inches wide, about 1 to 3 inches thick, and variable in length, preferably up to 200 to 400 feet long. A filter dimensioned in this fashion is particularly advantageous in its ease of installation; a 4 inch wide trench of appropriate depth is dug by a conventional trencher, and an appropriately dimensioned boot can position the drain against the inside wall of the trench, in a continuous process of installation. The trench can conveniently be immediately backfilled with the just-excavated material, which reduces the amount of "spoils" which need to be removed. The trench is sufficiently narrow that settling of the adjacent ground is minimized, and is sufficiently narrow to avoid entrapment of vehicle tires therein, if traffic encroaches upon the highway shoulder. The cost and delay of backfilling with sand or an aggregate is thus also avoided. Additionally, the cost of manufacture of the Hydraway drain is asserted to be significantly less than the costs of conventional drains.

One drawback of the Hydraway drainage system lies in the outlet and union structures employed in it. These structures fluidly connect an open end of the tubular filter to a drainpipe or to other filters. Several inconveniences have arisen during the use of these structures. The exit end of the filter slips into an open end of the outlet member or other structure employed, and is retained in place by an encirling piece of fabric carried by the outlet or other structure, or by stapling and wrapping with tape. This is disadvantageous in the amount of time and effort needed to be certain that the filter has not caught the fabric piece in the open outlet end, and needed to manipulate the fabric piece to extend it sufficiently over the filter to attach the filter to the outlet or structure. Of course, such attachment is hardly secure, as the filter may slide from the outlet or other structure if pulled during installation, or stressed during settling of the ground after installation. Moreover, the open end of the outlet or other structure is dimensioned very closely to the outside diameter of the filter. If the area of installation is muddy or gravelly, sliding of the filter into the opening may be hindered, and mud or gravel may be trapped between the fabric of the filter and the retaining fabric on the outlet. Additionally, the outlet is dimensioned only to accomodate a standard 4 inch drainpipe. The outlet requires a separate adapter fitting if it is desired to instead affix the outlet to a conventional flexible pipe. The known adapter fitting includes a piece of standard diameter pipe which must be bonded to the outlet. These drawbacks are costly in that they create trouble or delay precisely at the point of installation, after the trench has been cut, and after the "spoils" are exposed to the elements. Such disadvantages with known systems are likely to be even more noticable in instances where an outlet serves to join two or more sections of filter inlet tubes and also serves as a drain connection.

SUMMARY OF THE PRESENT INVENTION

The present invention overcomes these and other drawbacks by providing an outlet structure for use in conjunction with drainage systems of this type which makes the systems easier and thus less costly to install. The word "outlet" member is employed in its broadest sense, as any structure fluidly connecting an upstream and a downstream fluid passageway, and thus includes junctions, unions, and the like as well as means providing a drain connection therefore. The drainage system according to the present invention is useful for directing water to a drainpipe, and comprises a fabric tube having a discharge end, a self-sustaining water porous fabric tube support disposed in the fabric tube and extending generally up to the discharge end of the tube, and an outlet member fluidly connecting the discharge end of the fabric tube and the drainpipe. The outlet member includes an open end dimensioned to compressively receive and retain the discharge end of the fabric tube and the support therein. The invention is characterized in that at least one of the outlet member and the support is stiff but slightly resilient, this resiliency creating the compression retaining the tube and support in the open end of the outlet member.

Preferably, the outlet includes a flared portion on its open end which facilitates insertion of the discharge end of the fabric tube and the support into the outlet member. The outlet member also preferably includes a plurality of inwardly depending ramp surfaces or projections which engage the fabric tube and the support so that the fabric tube is trapped between the support and the outlet member. Preferably, the outlet member also includes a corrugated tubular drain connector for attaching either a straight or a flexible drainpipe to the outlet member. The tubular drain connector can be molded integrally with the outlet member, or can be separately formed and attached to the drain connector. Alternatively, when configured as a union, the outlet member can comprise two or more open ended sections, each of which is configured to receive and retain a fabric tube with its porous support member, one of which tubes may be a drain for the other[s]. Alternatively, the union may have a separate drain connector for the several tubes.

The drain structure of the present invention is particularly advantageous in that the flared portion on the outlet member and the retaining projections allow compressive attachment of the fabric tube and its support to the outlet member, and provides an outlet member and, or, union attachment which can be more quickly and readily connected to the filter tubes and is less susceptible to impairment than those employing existing methods and structure for attaching such drains to their associated outlets. Moreover, the ramped projections serve to positively secure the fabric tube and the support in the outlet without requiring employment of additional means such as tape, staples or the like. The present invention also avoids the delay of an additional construction step required to affix an adapter for flexible pipe to the outlet. The most significant improvement of this present invention, however, is that all three of these advantages can be achieved simultaneously, minimizing the time necessary for installing a drain of this type.

BRIEF DESCRIPTION OF THE DRAWINGS

FIG is a partial cross-sectional view of a preferred embodiment of the present invention in operative association with a roadway.

DETAILED DESCRIPTION OF THE PREFERRED EMBODIMENT OF THE PRESENT INVENTION

Figure 1:
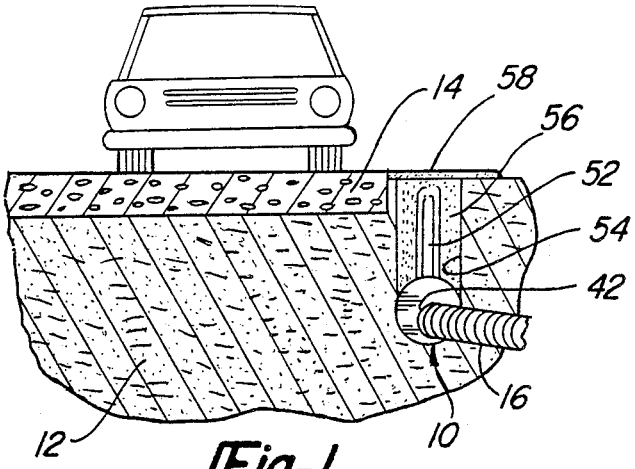
Figure 2:
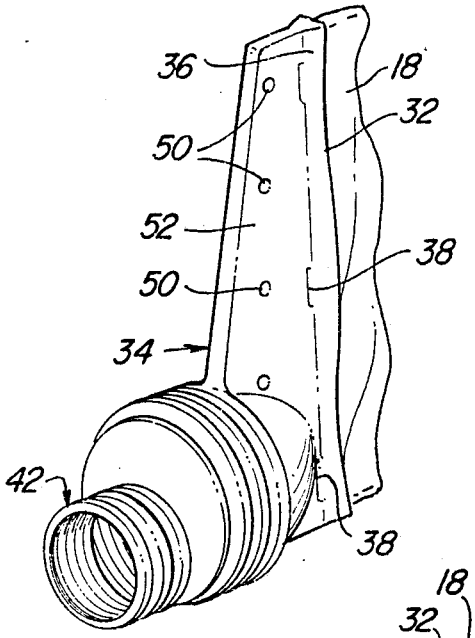
FIG. 2 is a perspective view of the embodiment shown in FIG. 1.
Figure 3:
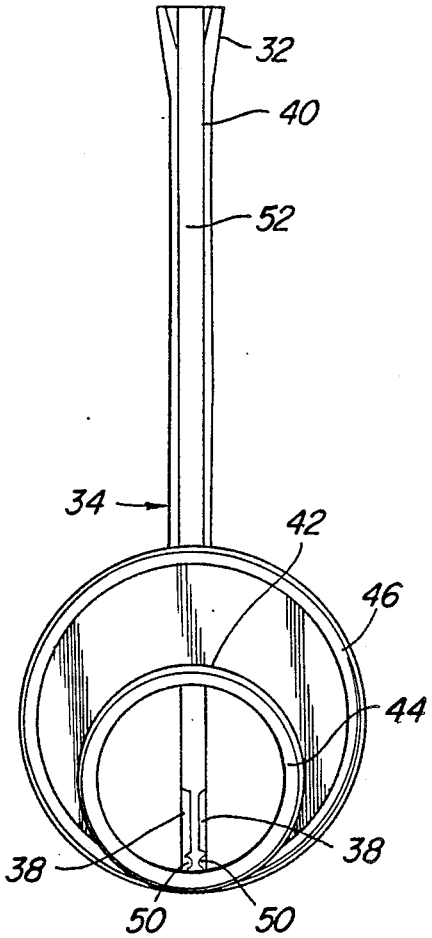
FIG. 3 is an end view of the embodiment of FIGS. 1 and 2.
Figure 4:
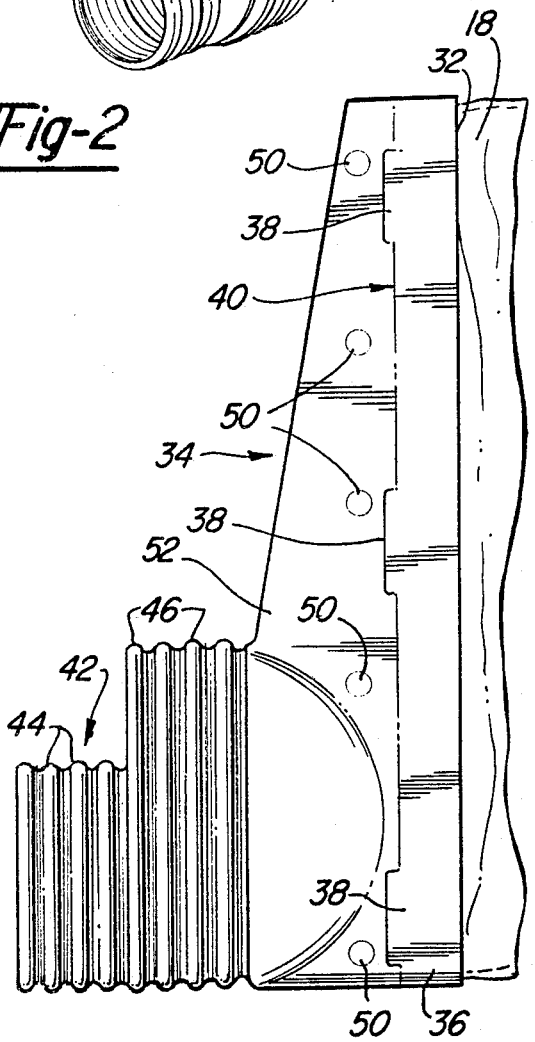
FIG. 4 is a side view of the embodiment of FIGS. 1–3.

With reference first to FIG. 1, a first preferred embodiment of the drainage system 10 according to the present invention is thereshown disposed in a pavement subbase 12 adjacent a stretch of ground cover, for example, a piece of pavement 14. The system 10 is connected to a drainpipe 16 for drainage of water from the subbase 12 through the system 10 and out the pipe 16.

Figure 5:
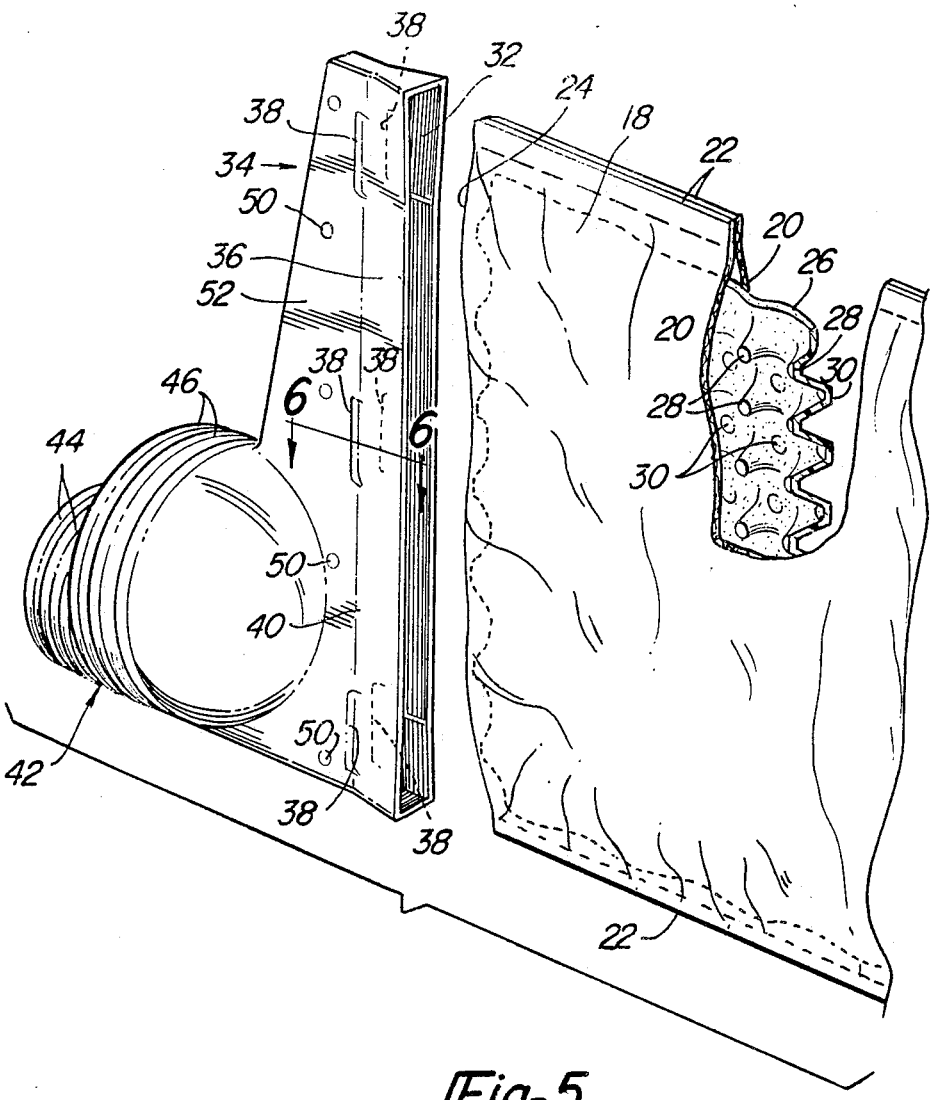
FIG. 5 is an exploded partial perspective view of the embodiment of FIGS. 1–4 with the fabric tube and the outlet member thereof disconnected and with a portion of the fabric tube broken away for clarity.

With reference now to FIGS. 2 through 5, the drainage system 10 of the present invention is further shown and first comprises at least one fabric filter inlet tube 18 constructed from an elongated pair of porous fabric segments 20 which are affixed together by sewing at their longitudinal edges 22, FIG. 5. The fabric tube 18 is constructed of a fabric which is resistant to biological action and preferably comprises a geotextile material, such as nonwoven spunbonded polypropylene. Conveniently, the pair of fabric segments 20 can be part of a single piece of fabric which is folded over to bring the longitudinal edges 22 into abutment for sewing. In any event, the fabric tube 18 is disposed along the edge of the pavement 14, preferably extending somewhat beneath the level of the pavement 14, and includes a preferably open discharge end 24 through which the collected water passes.

Figure 6:
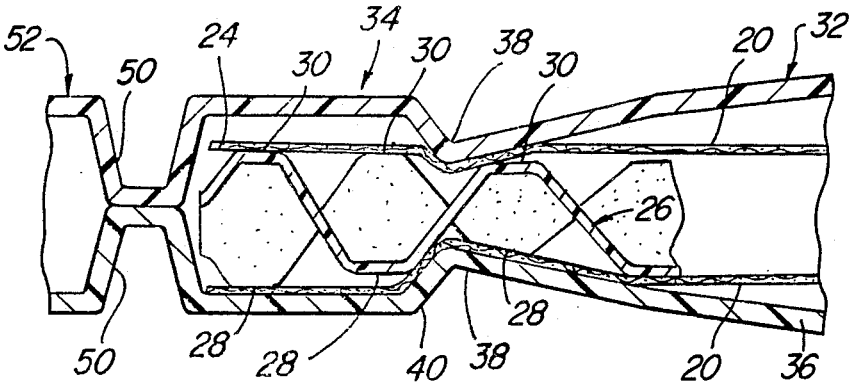
FIG. 6 is a fragmentary cross-sectional view taken generally along lines 6—6 of FIG. 5 but showing the components of FIG. 5 in assembled relation.

The drainage system 10 also includes a self-sustaining flexible and water porous support 26, FIGS. 5 and 6, disposed in and extending the length of the fabric tube 18, up to the open discharge end 24 of the fabric tube 18. The support 26 is preferably constructed from a sheet of inert plastic material, double cuspate in shape, and includes a regular array of a plurality of elevations 28 spaced by a similar array of symmetrically formed depressions 30. The support is preferably composed of high density polyethylene or polystyrene. The designation of these projections as elevations or depressions is made arbitrarily, relative to viewing the support 26 from one side of the support 26. In any event, the support must be constructed so as to allow water to pass through the sides 20 of the porous fabric tube 18, along or through the support 26, and out the discharge end 24 of the tube 18.

The system 10 of the present invention also includes an outlet member 34 having at least one open inlet end 32 in which the discharge end 24 of the fabric tube 18 is received. The open inlet end 32 of the outlet 34 includes a flared portion 36, and a plurality of inwardly depending ramped projections 38 are formed adjacent the inner edge 40 of the flared portion 36.

The outlet member 34 also comprises a tubular drain connector 42 located opposite the open end 32 of the outlet member 34. A first plurality of beads 44 having a first diameter are formed on the outer surface of the tubular drain connector, while a second plurality of beads 46 of a second, larger diameter are also formed on the outer surface of the tubular drain connector 42, but interior of the beads 44. The interior of the tubular drain connector 42 is dimensioned to slidably receive and frictionally retain therein a rigid drainpipe of conventional diameter, for example, four inches.

The tubular drain connector 42 is separated from the open end 32 of the outlet member 34 by an intermediate portion 52. The outlet member 34 is preferably constructed of an inert molded plastic material, being formed of a continuous substance throughout its extent.

Preferably, the intermediate portion 52 of the outlet member 34 includes a plurality of stops 50 projecting inwardly, and disposed in a line parallel to the inner edge 40 of the flared portion 36, opposite the open end 32 of the outlet member 34.

Use of the system 10 according to the present invention is straightforward. A trench 54 is dug parallel to the pavement 14 of a width and height slightly larger than but generally corresponding to the width and height of the outlet member 34. The length of the trench is arbitrary and preferably can be dug as a continuous process. A length of tube 18 and its associated support 26 is selected, and the open discharge end 24 of the fabric tube 18 and the enclosed supports 26 are inserted into the open end 32 of the outlet member 34. The flared portion 36 of the outlet member 34 permits this to be done even under muddy or gravelly conditions. The discharge end 24 of the fabric tube 18 and the encased support 26 are inserted into the open end 32 of the outlet member 34 a sufficient distance past the inner edge 40 of the flared portion 36 so that the projections 38 press against the support 26 and fabric tube 18 at open locations between the elevations 28 and depressions 30 of the support, so as to retainingly trap the fabric tube 18 between the support 26 and the projections 38. The fabric tube 18 is thus supported throughout its length yet firmly retained in the outlet member 34.

Once this connection is made, the outlet member 34 and the fabric tube 18 along with its enclosed support 26 are disposed in the trench 54. At this time, the tubular drain connector 42 of the outlet member 34 is connected to the pipe 16 in any convenient fashion. For example, if the pipe 16 is conventional flexible corrugated tubing of an interior diameter properly matching the diameter of the exterior of beads 44, the end of the pipe 16 is merely slipped over and frictionally retained upon the beads 44. If a larger tubing having an internal diameter properly matching the diameter of the exterior of beads 46 is preferred, then it likewise is simply forced over, and then frictionally retained upon, beads 46. Alternatively, rigid piping can be used, and the pipe can be slipped into the tubular drain connector 42, interiorly of the beads 44. In either case, once the outlet member 34 is connected to the drainpipe 16, and the outlet member 34, the fabric tube 18 and the support 26 located in the trench 54, the remainder of the trench 54 is then filled with fill material 56, and if desired, covered with a road shoulder 58.

Figure 7:
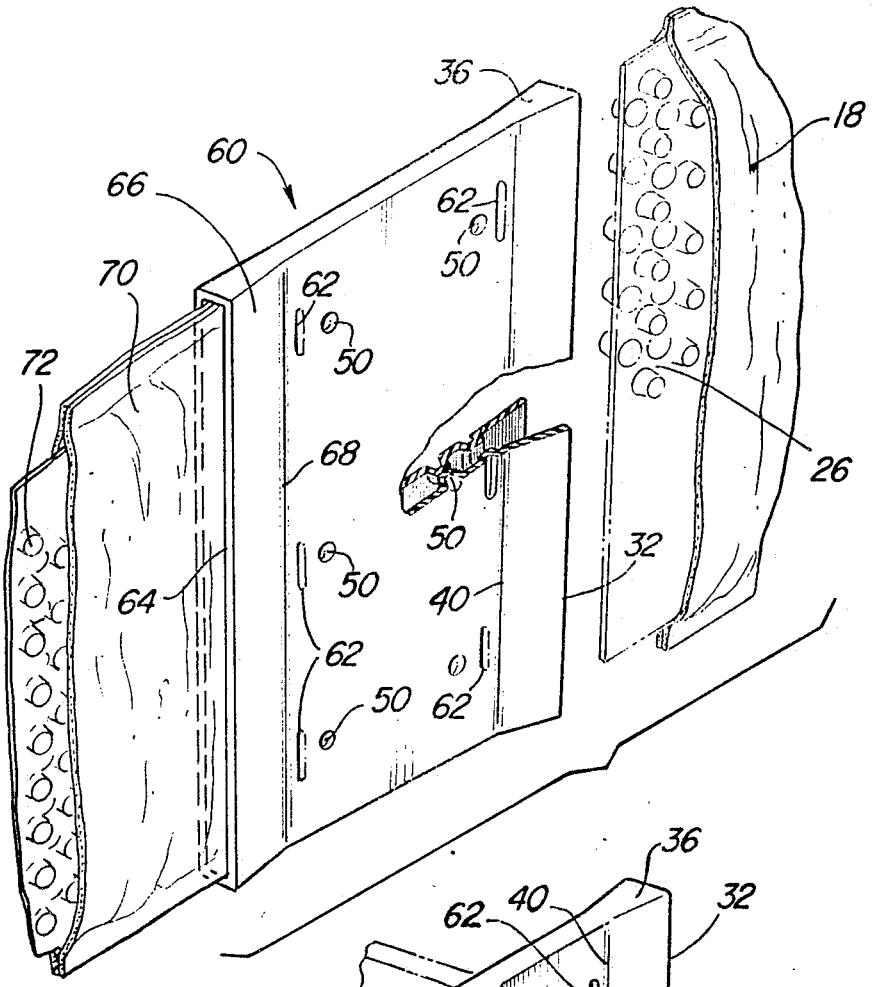
FIG. 7 is a perspective partially cut away view of another preferred embodiment of the invention showing some components thereof partially assembled.

Another preferred embodiment of the present invention is shown in FIG. 7, where the outlet member is configured as a union 60 joining two sections of drain. More particularly, the union 60 is generally flat and rectangular in shape, and comprises the open inlet end 32 and flared end portion 36, described in connection with the outlet member 34. The union 60 includes a plurality of elongated and rounded projections 62 located just inward of the inner edge 40 of the flared portion 36, serving the same purpose as the ramped projections 38. A plurality of the stops 50 are also included. Like the outlet 34, the open end 32 of the union 60 receives and compressively retains therein the upstream fabric inlet tube 18 and its enclosed double cuspate support 26.

The union 60 also comprises an open end 64 configured substantially the same as the inlet end 32, having an outwardly flared portion 66, a plurality of the projections 62 spaced slightly inward of an inner edge 68 of the portion 66, and a plurality of the stops 50. Like the open end 32, the open end 64 receives and compressively retains therein a downstream geotextile fabric outlet tube 70 having a double cuspate plastic support 72 contained therein. The fabric outlet tube 70 and support 72 are preferably identical to the fabric inlet tube 18 and support 26.

Figure 8:
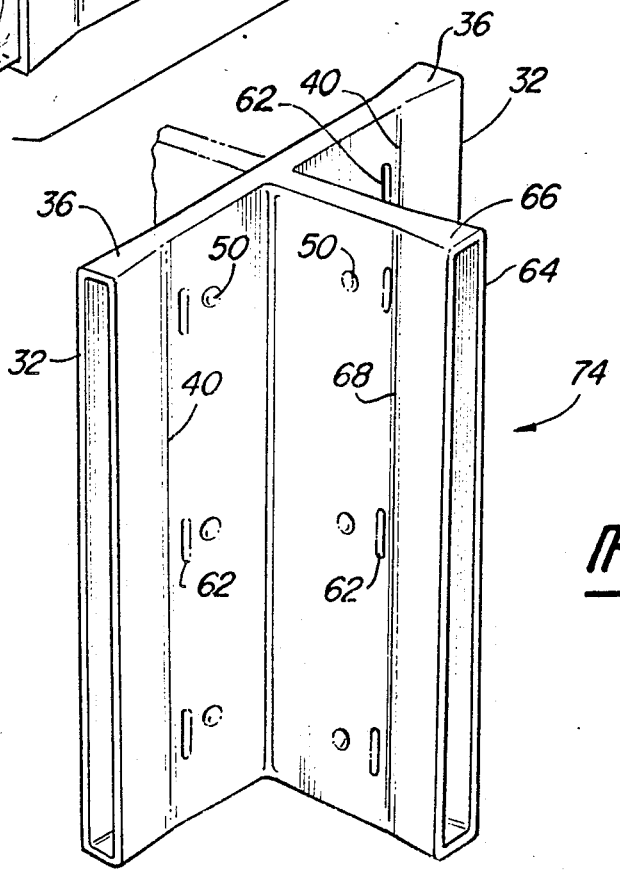
FIG. 8 is a perspective view of yet another preferred embodiment of an outlet member according to the present invention.
Figure 9:
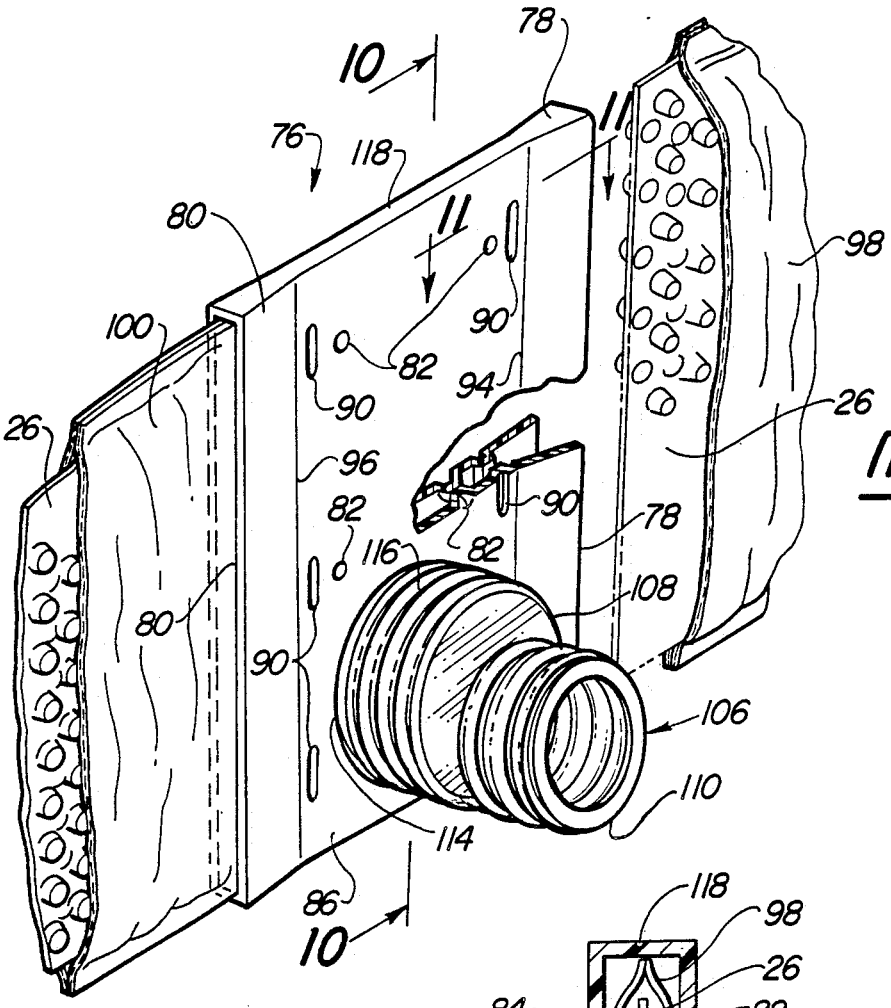
FIG. 9 is a perspective partially cut away view of a further preferred form of the invention showing some of the components partially assembled.
Figure 10:
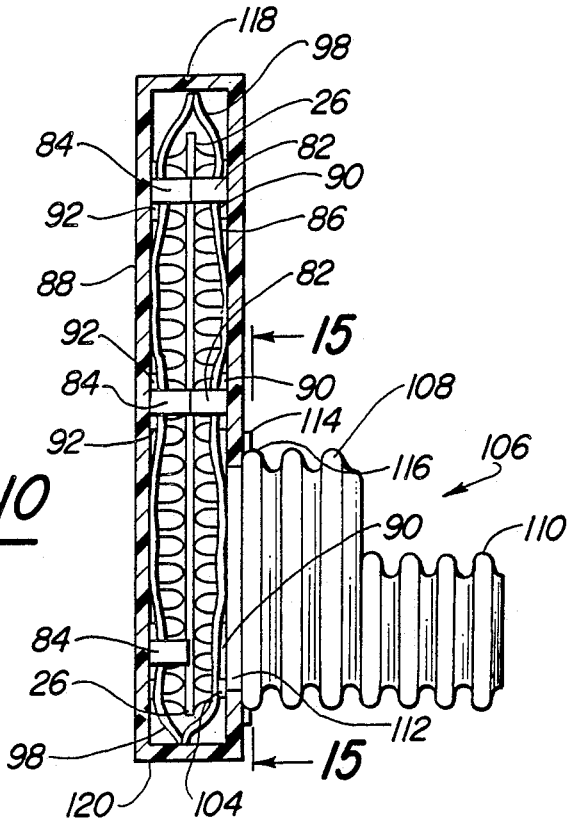
FIG. 10 is a sectional view taken along line 10—10 of FIG. 9; but showing components in assembled relationship.
Figure 11:
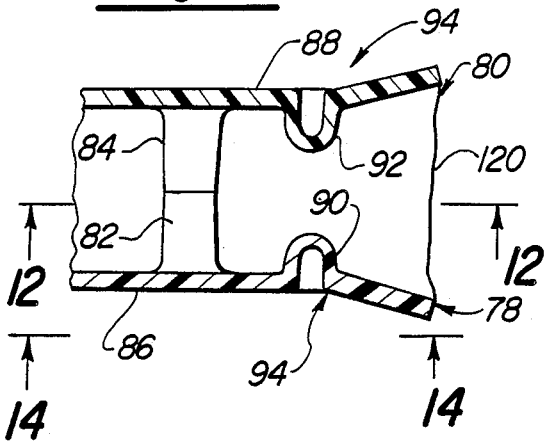
FIG. 11 is a section taken along line 11—11 of FIG. 9.
Figure 12:
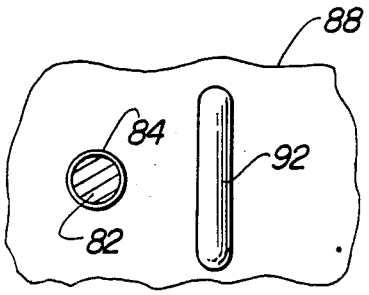
FIG. 12 is a sectional view taken along line 12—12 of FIG. 11.
Figure 13:
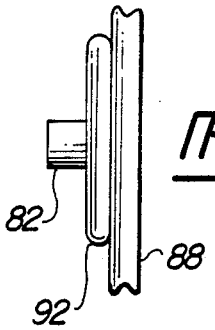
FIG. 13 is an end view of the structure shown in FIG. 12.
Figure 14:
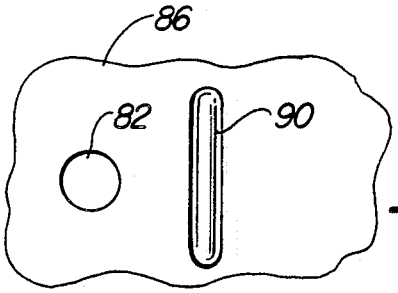
FIG. 14 is a fragmentary elevation view taken along line 14—14 of FIG. 11.

Still another preferred embodiment of the present invention is shown in FIG. 8, where the outlet is configured as a T-shaped junction 74 including two preferably coplanar inlet ends 32 receiving therein two upstream fabric inlet tubes 18 and their contained supports 26 (not shown). The junction 74 also comprises the open end 64 described above, which receives and compressively retains the downstream fabric inlet tube 70 and enclosed support 72 (also not shown). The junction 74 is otherwise constructed in the same fashion as the union 60, with the corresponding flared ends 36 and 66, the projections 62 and the stops 50 performing their same functions.

In FIGS. 9–15, a further preferred embodiment of the invention is shown. In this instance, the outlet member 76 is similar to outlet member 60. Member 76, thus, has a pair of outwardly flared vertically extending end portions 78 and 80 as well as a plurality of stops 82 and 84 which as illustrated in FIGS. 11–15 project inwardly of the vertical platelike sides 86 and 88. The stops of plate 86 are in alignment with the stops of plate 88 and both sets of stops, those on the two plates, project inwardly into abutting relationship each with their respectively opposed stop. As shown, stops 82 and stops 84 are of equal length and intersect roughly in the median plane between the two side plates 86 and 88. They thus limit any inward movement of the platelike sides and prevent a collapse thereof.

Elongated vertically extending projections 90–92 are also provided adjacent the inner limits of the flared ends. The inner limits are defined by the demarkation ridges 94 and 96, see FIGS. 11–15, which mark the junction of the flared ends 78 and 80 with the main section of the two platelike sides 86 and 88 respectively. These elongated projections are sized so as to compress and crimp the fabric inlet tubes 98 and 100, respectively in such a manner that the tubes will be locked in position within the outlet member 76. The fabric tubes are of the same construction as those shown in FIGS. 1–7 and it will be realized that they will function in the same manner. They each comprise the porous fabric and tubular enclosure 18 formed of segments adhered at the upper and lower edges as by sewing or glueing, and the enclosed supports 26. They have open ends 24, FIG. 5.

The stops 82–84 and the projections 90–92 are preferably formed integrally with the outlet member in a single molding step. The projections 90–92 extend vertically parallel to the flared ends inwardly thereof. They project inwardly in paired opposing relationship to each other sufficiently to permit passage of a tubular filter inwardly of them but also sufficiently to offer resistance to such movement and to crimp the filter elements sufficiently to retain the filter elements in position after they are forced inwardly beyond the pairs of projections. The stops 82–84 are positioned inwardly of the flared ends sufficeintly to allow an ample amount of the reinforced filter tubes to enter beyond the projections 90 and 92 to affect a secure bond but also by virtue of their projection between the platelike sides they form stops preventing excessive movement of the filter tubes inwardly of the outlet member thus insuring free flow of the fluids through the outlet member and its associated drain connector described below.

As shown in FIGS. 5, 6, 7 and 9, the elevations 28 and depressions 30, FIG. 5, are arranged in vertical rows with the spacing between the elevations being sufficient to enable entrance of the projections 90 between the rows and a forcing of the fabric inwardly between the rows. This results in a grasping or impingment of the tubular fabric tube and their supports 26 in a manner to hold them in place. The support 26 and the panels 86 and 88 are sufficiently resiliently deformable to permit passage of the inlet tubes 98 and 100 inwardly of the outlet members but stiff enough under urging of their resilient natures to obtain a secure grasp of the inlet tubes in the outlet member.

Figure 15:
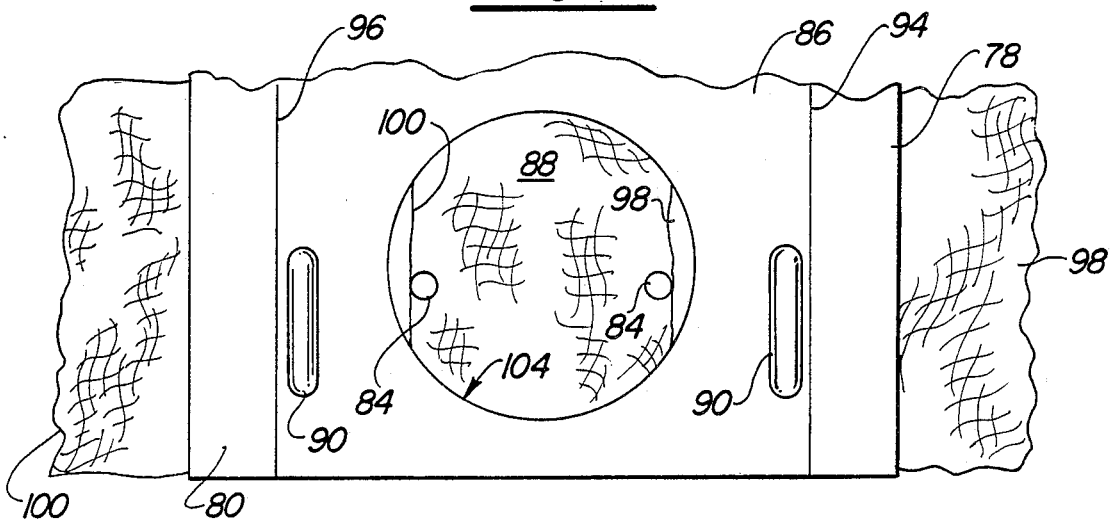
FIG. 15 is an elevational view taken along line 15—15 of FIG. 10 but with a connector member removed and showing two inlet tubes connected to an outlet member.

Adjacent to base 102 of at least one platelike side 86 there is provided a drain opening 104, FIG. 15, substantially longitudinally inwardly between the flared ends 78 and 80. Tubular drain connector 106 is secured within and projects outwardly from the drain opening 104 in plate 86 in the same manner as drain connector 42. Drain connector 106 is of the same construction as drain connector 42 and provides connective beads or ridges 108 and 110. The connector can on the other hand have helical ridges upon which or into which suitable pipe can be threaded. Thus a range of tubular pipe can be connected to the outlet member for directing water away from the strata to be protected. The connector shown, 106, is of molded material and the ridges provide both stiffening for the connector as well as a means for securing drain pipe to the connector 106. The drain connector flange 112 can be used to secure the drain connector to the panel 86 by adhesives. Mechanical bonds can also be used as can an additional flange such as 114 adjacent the intermost bead 116.

The inlet tubes 98 and 100 are simply inserted into the open flared ends of outlet members 76, forced beyond the vertically extending projections 90–92, and into engagement with stops 82–84 in order to obtain secure connections between the outlet member and the inlet tubes. When in this relationship the projections 90–92 form crimped indentations within the inlet tubes, see FIG. 5, which prevents withdrawal of the inlet tubes.

The outlet member is formed preferably of molded synthetic material such as fabric reinforced polyethelyne. The material is resiliently deformable to the extent that the fabric tubes can be forced beyond the flared ends and beyond the projections 90–92 to the stops 82–84, but will be firmly grasped by the projections and retained in position due to the strong inward force exerted by the platelike sides. The upper and lower ridges 118 and 120 of the outlet member provide a stiffening to the platelike sides tending to retain the platelike sides in facing relationship with the respective stops 82 and 84 abutting each other. The flares at the sides of the outlet member as well as the demarkation ridges at the inner edges of the flared ends 94 and 96 add to the stiffness and tend to cause the resilient material to seek to retain the shape illustrated in the figures and in which the projections 90–92 are resiliently held in the relationship indicated in FIGS. 7, 9, 10 and 11.

The present invention thus provides several improvements over the prior drainage system. Because the fabric tube 18 and the support 26 are retained by insertion into the outlet member 34, there is no time wasted in attempting to draw or fasten a second piece of fabric over them at the outlet end of the tube. Indeed such a connecting or covering piece can be excluded by the present invention, as the tube 18 and support 26 fully occlude the open end 32 of the outlet member. Moreover, the flared portion 36 on the open end 32 of the outlet member 34 allows the ready insertion of the fabric tube 18 and the support 26 into the outlet 34 even under adverse conditions. The beads 44 and 46 formed on the outside of the tubular drain connector 42 also speed installation of the system, by allowing connection of the outlet member 34 to both straight pipe and corrugated pipe drains 126 without requiring an additional fitting. Lastly, the projections 38 serve to retain the fabric tube 18 and support 26 in the open end 32 of the outlet member 34 without requiring any additional securing or attaching means.

Conveniently, the fabric tube 18, support 26 and open ends such as 32 of the outlet member 34 are provided in sizes ranging from 6 to 60 inches in height, of either ¾ or 1½ inches thickness, and of upwards of 200 to 400 feet in length. The first beads 44 are sized to receive a six inch nominal diameter flexible pipe thereon, while the second beads 46 are sized to receive an eight inch nominal diameter flexible pipe thereon. The inside diameter of the tubular end 42 is preferably four inches.

Also conveniently, the support 26 has a waffle-like profile, porous in all directions and along both sides of its major plane. It preferably has a compressive strength (ASTM D162 mod.) of at least about 5000 psf. Additionally, the fabric tube 18 has a water transmitivity of 22 U.S. gpm/sq. ft. (at 2000 lb./ftt, i=1). When constructed of the preferred materials and structured according to the particularly described embodiment, the system transmits water along each side of the tube at a rate of at least about 5 gpm per foot of support width, at a lateral earth pressure of 10 psi. Such a structure, however, weighs merely about 0.20 lb./sq. ft. of lateral area.

Having described my invention, however, many modifications thereto will become apparent to those skilled in the art to which it pertains, without deviation from the spirit of the invention, as defined by the scope of the appended claims.

I claim:

1. A drainage system outlet member comprising facing resiliently deformable platelike side members, said side members being joined along opposite pairs of upper and lower edges of each by ridges and being spaced from each other between said ridges, said side members having paired flared portions extending laterally of said ridges and providing flared openings in said outlet member, stops projecting inwardly of said side members at spaced locations thereof with the stops of one side member facing the stops of the other side member and serving to limit inward movement of one of said side members relative to the other, a series of vertically extending projections extending inwardly of each of said platelike side members intermediate said flared portions and said stops and forming means for retaining by impingment material inserted into said outlet member beyond said projections, one of said side members having a drain opening formed therein adjacent the lower of said ridges and inwardly of said flared ends, a drain connector in said drain opening for connection to a drainage means for draining fluid away from said outlet member.

2. The drainage system outlet member of claim 1 wherein said stops are inwardly of said flared ends, said stops on one of said side members being in contact with opposing stops on the other of said side members, and said side members being resiliently urged inwardly toward each other.

3. The drainage system outlet member of claim 1 including, said projections being arranged in opposed facing relationship inwardly of the respective said side members, and the opposed projections being spaced from each other.

4. The drainage system outlet member of claim 1 wherein said projections are in vertically spaced pairs arranged in facing but spaced relationship extending transversely of said side members and form means for compressing deformable material inserted into said outlet member and extending between said flared portions and said stops.

5. The drainage system outlet member of claim 1 wherein said flared openings extend from a main section of said facing platelike side members and are adjoined thereto along vertically extending demarkation ridges which together with the first mentioned ridges supply stiffness to said outlet member.

6. The drainage system outlet member of claim 1 wherein said stops extend in vertical rows parallel to said flared portions.

7. The outlet member of claim 4 wherein said projections extend in vertical rows intermediate said stops and said flared ends.

8. The drainage system outlet member of claim 7 wherein said projections form retaining flanges for embedding into resilient drainage members inserted inwardly of said outlet members beyond said flared ends.

9. The drainage system outlet member of claim 1 wherein said stops form barriers inwardly of said flared portions for limiting inward movement of drainage members inserted into said outlet members through said flared openings.

10. The drainage system outlet member of claim 1 including a fabric inlet tube comprising a porous fabric enclosure and an enclosed support, said support comprising means forming a regular array of elevations spaced by depressions with said fabric tube being freely deformable into said depressions.

11. The outlet member of claim 10 including said inlet tube being sized so as to be insertable into one of said flared openings of said support member and being sufficiently resiliently deformable to be urged beyond said projections adjacent said one of said flared ends and into engagement with said stops inwardly of the latter said projections within said outlet member upon insertion of said tube into said member.

12. The outlet member of claim 11 including said support having depressions of sufficient length vertically and horizontally for reception of said projections and of fabric impinged upon said projections with said projections extending adjacent said elevations in said support.

13. The outlet member of claim 10 including said support being sufficiently resilient that it can be resiliently deformed and moved inwardly of said projections and between said projections and said stops.

14. The outlet member of claim 10 wherein said outlet member includes a second fabric inlet tube insertable into the other of said flared openings of said support member.

* * * * *